US005139048A

United States Patent [19]

Armstrong

[11] Patent Number: 5,139,048

[45] Date of Patent: Aug. 18, 1992

[54] DIRECT POWERED GATE VALVE

[76] Inventor: George W. Armstrong, 114 Schneider Dr., Fairborn, Ohio 45324

[21] Appl. No.: 775,006

[22] Filed: Oct. 11, 1991

[51] Int. Cl.[5] ..... F16K 1/20; F16K 31/163; F16K 37/00

[52] U.S. Cl. ..... 137/553; 137/556.3; 251/58; 251/62; 251/301

[58] Field of Search ..... 137/553, 556.3; 251/58, 251/62, 301

[56] References Cited

U.S. PATENT DOCUMENTS 3,380,475 4/1968 Armstrong .
3,907,178 9/1975 Armstrong .
3,916,949 11/1975 Armstrong .

*Primary Examiner*—Gerald A. Michalsky
*Attorney, Agent, or Firm*—Biebel & French

[57] ABSTRACT

An enclosed gate valve for handling dry particulate material has a rectangular housing, and a curved flow control blade moves through the housing adjacent a housing inlet. The flow control blade is moved by an air cylinder mounted on an inclined and laterally offset wall of a housing compartment. A direct connection is formed between the piston rod of the air cylinder and the arm means supporting the curved flow control blade so that force from the cylinder is applied directly to the blade along a line of movement which is substantially tangent to the arc of blade movement to provide maximum advantage of the power available from the air motor in both the opening and the closing directions. Embodiments are shown of coupling arrangements for attaching the piston rod of the air motor to the blade arms. An indicator pointer provides a visual indication of the movement of the curved blade.

7 Claims, 3 Drawing Sheets

DIRECT POWERED GATE VALVE

BACKGROUND OF THE INVENTION

This invention is directed to a gate valve and more particularly to a rolling blade type of valve which is directly powered from a piston, such as an air piston.

In my patent, U.S. Pat. No. 3,916,949 issued Nov. 4, 1975, I disclose a rolling blade type of gate value for controlling the flow of dry particular material through a rectangular conduit or housing section. In that patent, the valve housing was formed with a laterally offset portion, opening into the interior of the valve, into which the rolling blade and its support arm structure moved in a retracted position. Further, the rotation or movement of the blade was by an external air cylinder working through an extension arm or lever mounted on a blade pivot pin or shaft. Thus, the torque of opening and closing the blade, applied by the air motor, was delivered through the blade through the blade mounting shaft and was not as efficient as a direct connection between the air cylinder and the blade. Further, the open offset blade-receiving housing portion at times could be a disadvantage due to the fact that material flowing through the valve conduit could also flow into the offset portion and interfere with the blade mounting and pivoting mechanisms.

In my patent, U.S. Pat. No. 3,380,475, I show an air cylinder for moving the rolling or curved blade of a gate valve in which the cylinder is connected to the blade support arm at a location close to the pivot by means of an intermediate arm extension portion. This arrangement has the advantage of operating the blade at a location outside of the flow conduit, but has the disadvantage of an awkward mechanical connection which does not take full advantage of the thrust of the air cylinder in opening the blade, due to force vectors applying force at a substantial angle to the direction of blade movement.

SUMMARY OF THE INVENTION

The present invention is directed to a gate valve which is an improvement over my prior patents, and more particularly to such a gate valve having an improved direct drive relationship between an air cylinder and the bade supporting arms. I provide a wall of an offset sealed or closed blade-receiving compartment which forms a flush mounting surface for a cylinder. The piston rod moves along a line which is substantially tangent to the arc of blade movement, or which forms a direct chard line with respect to the arc. The arrangement is one which takes maximum advantage of the power available from the air motor in both the opening and closing directions, with minimum side thrust on the piston rod.

The improved roller blade valve of this invention is totally enclosed and is therefore environmentally friendly. With the blade in the open position, the valve presents a fully unobstructed conduit passage therethrough. An internal wall forming one side of the conduit separates the valve operating mechanism and the blade arms in the housing offset compartment from the passage conduit so that there are no dead openings in the valve which can entrap or retain the material being conveyed.

In view of the efficient arrangement of the air cylinder with the blade arms, the valve blade can be moved with very low power consumption. Further, the direct air cylinder connection to the blade arms provides a valve which is capable of fast response time and one which has low maintenance.

The invention also includes an external indicator connected to rotate with the blade arms at the blade pivot. The indicator provides an external visual indication of the valve blade. Further, the pivot arm may be used to operate position indicating logic devices, such as miniature switches, magnetic switches, LED lights or the like.

In one embodiment of the invention, a yoke connects the blade arms with the piston rod through a roller and roller follower connection which provides a straight line movement of the rod during the arcuate movement of the blade connection. In another embodiment, the rod is connected to the blade arms through an intermediate pivotal connecting rod.

In each of the embodiments, the common connecting rod which extends transversely between the blade supporting arms, and which connects the piston rod to the blade, is preferably of a U-shape. This permits the relative position of the connecting rod to be reversed with respect to the piston rod, thereby accommodating different lengths of piston rods.

The actuating cylinder is preferably a bidirectional air cylinder although a return spring may be used in the form of a leaf or a coil spring in the housing to assist in moving the blade either to the retracted open position or the actuated closed position. The curvature of the blade with respect to the particulate material falling on its upper surface is such that the blade tends to move into the closed position, by reason of the component of the force of such material normal to the blade radius.

A particular advantage of the gate value of this invention resides in the fact that the housing is constructed such that all of the openings, including the arm pivots, the blade position indicator, the cylinder mounting, the service door and the mounting flanges are sealed to prevent leakage either from the inside out or from the outside in. All of these sealing surfaces can be gasketed, as necessary, to provide a truly enclosed valve. The blade can similarly be provided with seals, and a non-polluting valve construction is provided which may operate even under some positive internal pressure.

The offset housing which provides for movement of the blade and the support arms is arranged such that any material which accumulates will fall through and exit through the outlet opening. It is also arranged so that air blast purging may be used to keep this space clean and clear of the dry particulate matter being handled by the valve.

All of the sealing surfaces on the body are flat, thereby permitting the use of simplified gaskets and seals. The valve blade operator with the direct drive connection is one which has a minimum of travel with respect to the actuating mechanism, and therefore is subject to a minimum of wear.

It is accordingly an important object of this invention to provide an improved direct powered gate valve for dry particulate material in which a rolling blade is moved by an air cylinder mounted on the valve housing with a connection between the valve arms and the piston rod providing for a direct line of movement of the rod in the direction of blade travel.

Another object of the invention is the provision of a flow-controlling blade valve of the type described in which an external valve blade position indicator is connected to move by the blade support arms within the valve.

These and other objects and advantages of the invention will be apparent from the following description, the accompanying drawings and the appended claims.

DESCRIPTION OF ACCOMPANYING DRAWINGS

Figure 4:
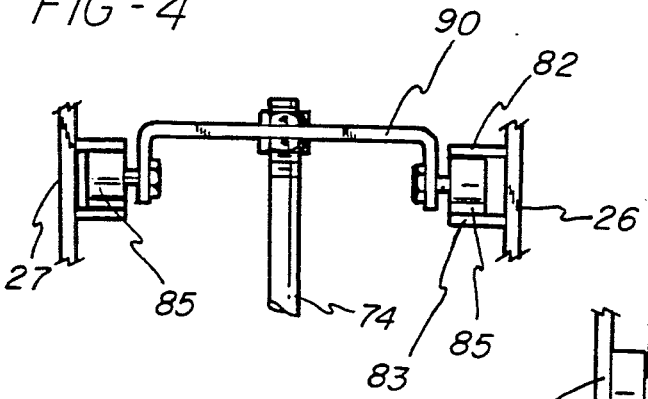
FIG. 4 is a fragmentary elevational view of the connecting arrangement of FIG. 3.
Figure 6:
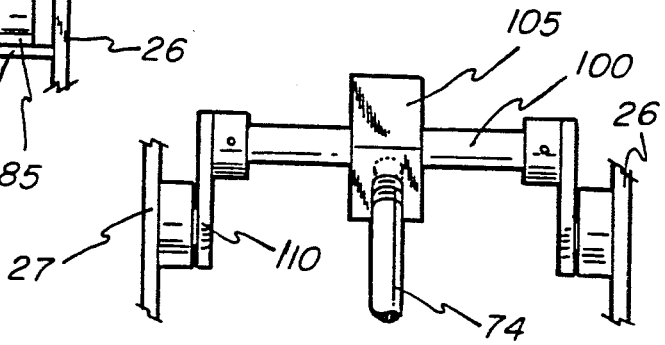
Figure 5:
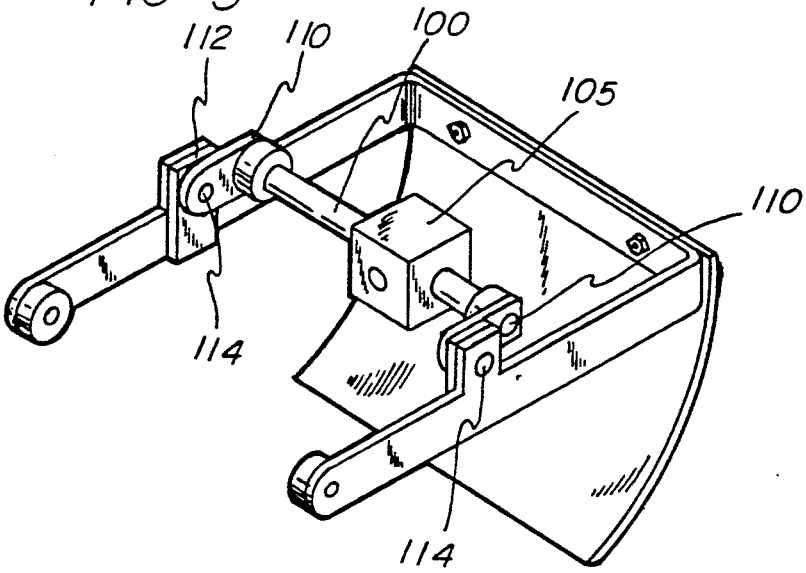
Figure 7:
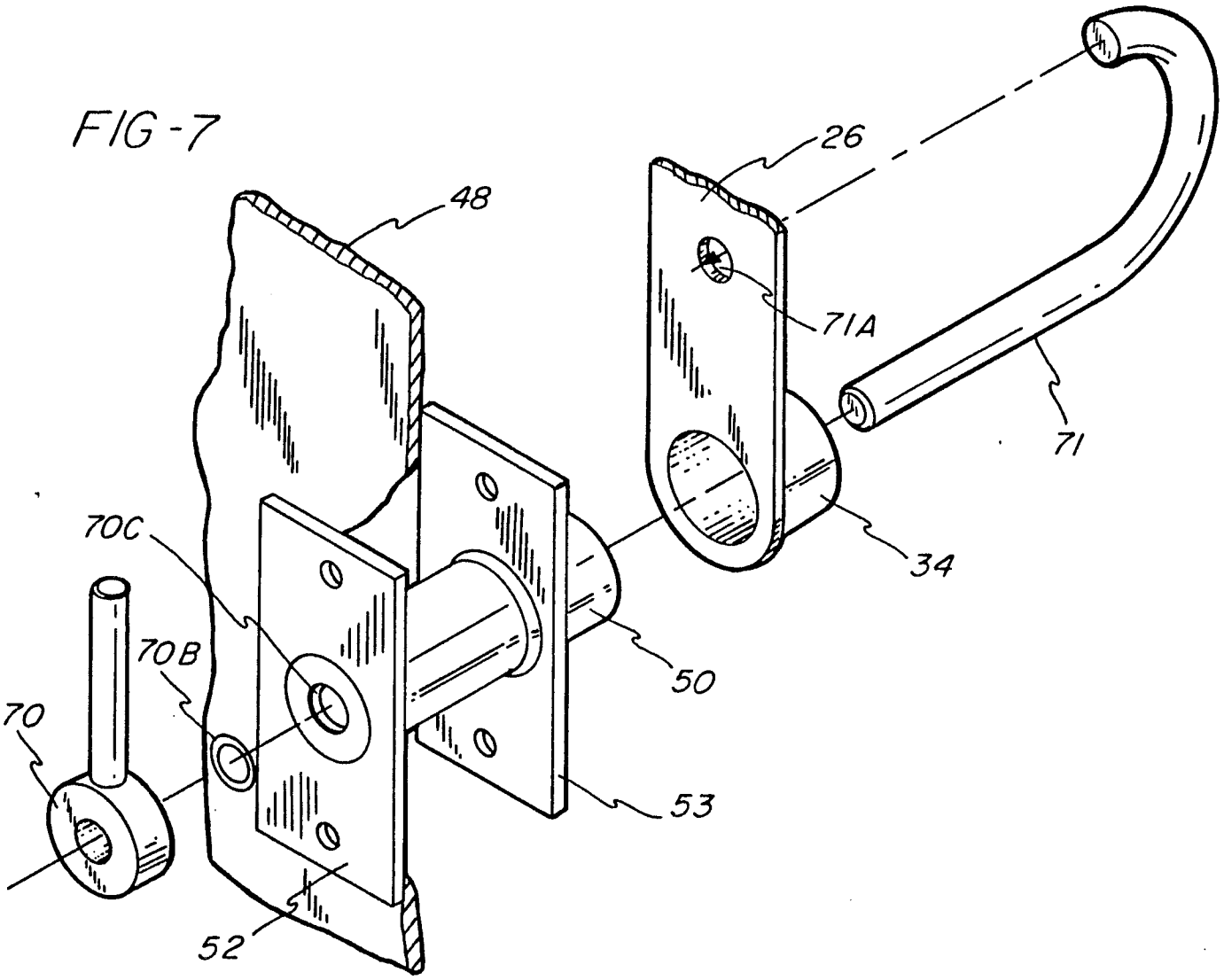

FIG. 5 is a further perspective view of blade supporting arms and blade, showing a further embodiment of a blade connecting rod for the piston rod; and FIG. 6 is a fragmentary elevational view, similar to FIG. 4, showing the embodiment of FIG. 5, with the piston rod attached, and FIG. 7 is an exploded fragmentary detail showing the mounting and drive arrangement for the blade position indicator or pointer.

DESCRIPTION OF PREFERRED EMBODIMENTS

Referring to the drawings, which illustrate preferred embodiments of the invention, a gate-type rolling blade valve 10 is illustrated as having a generally rectangular body or valve housing 12 defining a rectangular flow conduit 13 extending between an upper inlet 14 and a lower outlet 15. Both the inlet and outlet ends of the housing are formed with peripheral angle-type mounting flanges 16 thereby providing a convenient means by which the valve may be attached to a conduit.

Figure 3:
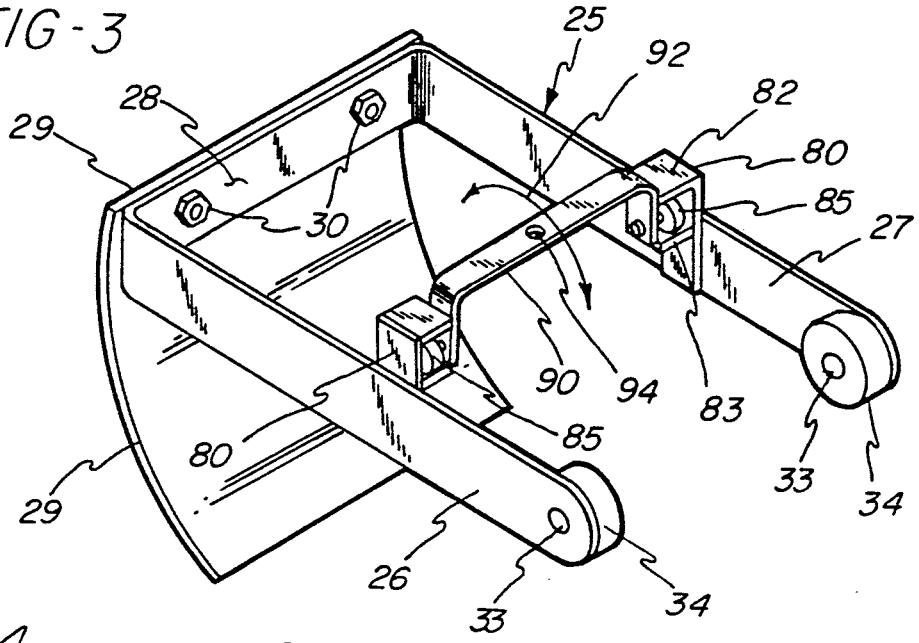
FIG. 3 is a perspective view of the rolling blade, the blade supporting arms, and a piston rod connection which provides for rolling of the connecting member with respect to the arms.

The valve 10 further includes a curved flow control valve blade 20 which has a width forming a close fit with the side walls of the rectangular conduit 13. The blade 20 is mounted on support means in the passageway or in the form of a generally U-shaped support arm 25. The arm 25 has a pair of parallel arm portions 26 and 27 extending form an upper cross portion 28. The cross portion 28 of the arm 25 is secured to the trailing edge 29 of the blade by fastener bolts 30, as shown in FIG. 3.

The blade 20 is curved with the concavity facing downwardly. The center of curvature may be substantially coincidental with pivot openings 33 formed in support bearings 34 at the lower ends of the arm portions 26 and 27. Also, the center of curvature of the blade 20 may be offset and positioned adjacent tho outlet 15 in the manner taught by my U.S. Pat. No. 3,389,475.

The housing 12 is formed with a laterally offset, closed compartment 40 formed by an outer wall which has three sections, a horizontal section 41, a diagonally downwardly extending section 42, and a longer inwardly extending flat section 44 which terminates at the bottom flange 16. The section 44 forms a flat surface for the mounting of an air cylinder thereon, as described below. The offset compartment 40 is closed by a pair of parallel side walls 48 which also close and form the side walls for the conduit 13. The wall section 42 is provided with a removable access cover or plate 47.

Figure 2:
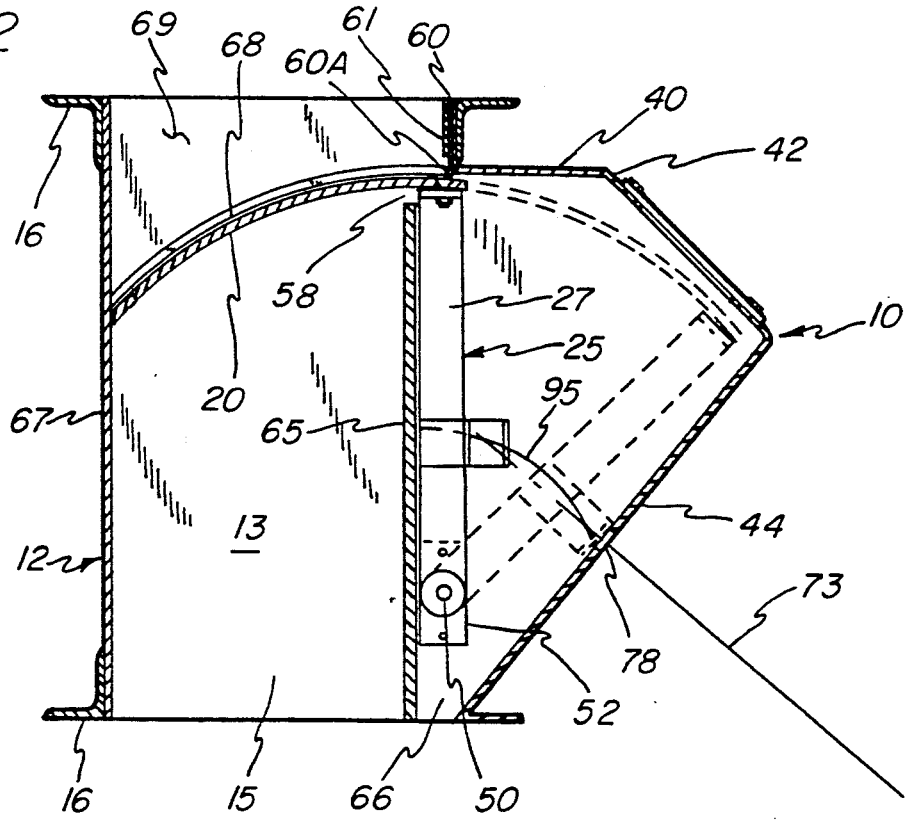
FIG. 2 is a vertical section through the valve of this invention.

The offset compartment 40 is shaped to receive the blade arm 25 and associated blade 20 in the open position of the blade, which is shown by the broken lines in FIG. 2. The blade supporting arm portions 26 and 27 are pivotally mounted to the housing side walls 48 on inwardly extending mounting pins 50 (FIG. 7). The pins 50 are mounted on pin supporting plates 52 and held in place by a backing plate 53 on an inside surface of the wall 48, as shown in FIG. 7. The position of the pin plates 52 and backing plates are adjustable on the respective side wall 48 of the valve body or housing for a limited extent by the provision of an oversized hole in the wall 48, and provide for the adjustment of the position of the blade 20 within the housing, and particularly with respect to the blade seals.

When the blade arms are mounted in the housing on the pins 50, the leading edge of the blade 20 itself extends through an upper slot 58 defined between an upper curved blade wiper 60 held by a retainer 61 and an internal wall 65, forming a back wall of the conduit 13. The wall 65 separates the conduit 13 from the interior of the offset compartment 40. As will be seen in FIG. 2, the blade 20 is movable on the pivot pins 50 to the closed position, as shown in full line. The wall 65 is open at 66 at its bottom, at the valve outlet 15, so that any material behind the wall 65 can fall into the outlet. Air blast purging of the blade arm offset housing may also be used to clear this compartment of accumulated material.

In the closed position, the nose or front edge of the blade is in sealing contact with a front wall 67 of the housing 12, and the arm portions 26 and 27 of the blade supporting arm 25 are positioned in close proximity to the outer surface of the conduit back wall 65. The blade is movable on the pivot pins to a retracted position as shown by the broken lines in FIG. 2, so that the blade is substantially extracted from the conduit section to permit free flow between the inlet 14 and outlet 15.

The upper blade wiper 60 at the slot 58 is formed with a lower inwardly curved end **60*a* which rides in wiping engagement with the top curved surface of the blade 20. The seal 60 extends laterally the width of the housing between, the side walls 48 and is retained by a retainer plate 61. A typical wiper blade construction usable with this invention is further illustrated at reference numeral 42 with a keeper plate 44** as more fully described in my prior U.S. Pat. No. 3,916,949.

The upper surface of the blade 20 is sealed in the closed position by side seals 68 retained by retainer plates 69. The retainer plates and the seals correspond to plates identified by the reference numeral 50, and seals identified by the reference number 48, described in greater detail in patent '949. Further, the movement of the blade 20 may be provided with a cam action by having the pivot point at the pin 50 offset somewhat from the center of curvature of the blade, so that the blade moves slightly upwardly into camming engagement with the side seals 68 during closing movement, as described more fully in my prior U.S. Pat. No. 3,380,475.

As previously described, an external blade position indicator 70 (FIGS. 1 and 7) is mounted for movement by the blade supporting arms, such as the arm 26, to provide a visual indication of the relative position of the blade 20 within the body or housing 12, and also to provide a positive indication of blade movement. For this purpose, as best seen in FIG. 7, one of the blade arm supporting pins is hollow to receive an extended end of a generally U-shaped drive or connector rod 71. The longer end of the rod 71 extends through an opening 70*c* formed in the bushing 50, and receives the position pointer or indicator 70 thereon, such as by a set screw or the like. The shorter inner end of the rod 71 is received within a hole or opening 71*a* formed in the arm 26 to provide a driving connection for the rod so that the rod rotates with the arm 26 thereby moving the pointer or indicator accordingly. An O-ring 70*b* may be received between the indicator 70 and the plate 52, received in a recess 70*c* on the face of the plate 52, for the purpose of sealing the opening formed in the bushing 50 for the rod 71 to prevent ingress or egress of contaminants therethrough.

The indicator 70 which may include a hub and a radially extending pin, may be observed to show whether the valve blade is in an open or closed position, and may be watched to see whether the blade is in motion. It may also be used to trip a switch or an air valve.

Figure 1:
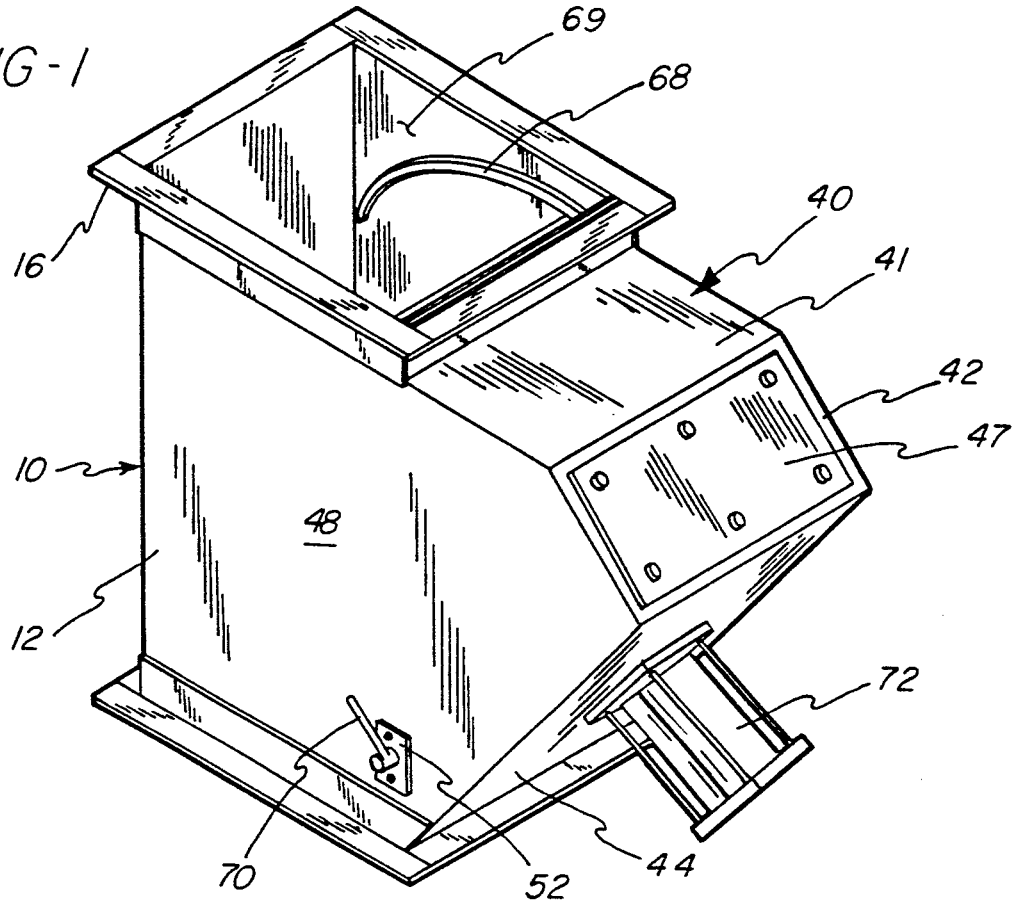
FIG. 1 is a perspective view of a gate valve made in accordance with this invention.

The invention is also directed to an improved direct coupling between a blade actuator motor, such as the air cylinder 72 shown in FIG. 1, and the blade support arm 25. In the interest of clarity, the air cylinder 72 is not shown in FIG. 2 but it will be understood that it will have its central axis positioned along a center line 73 with its push rod or piston rod 74 (FIGS. 4 and 6) extending through an opening 78 in the wall 44.

Two embodiments of direct connection arrangements are shown, by means of which the straight line movement of the piston rod 74 along the axis line 73 is coupled for movement of the blade arm 25. Referring first to FIGS. 3 and 4, each of the blade arms is provided with a cam follower receiving extension 80 which may be suitably spot welded to the inside of the associated arm. The cam follower extension 80 includes a pair of spaced-apart or opposed flanges or cam followers 82 and 83, proportioned to receive a roller, such as a cam follower roller 85, therebetween. The rollers 85 are connected by a generally U-shaped yoke cross member or connector rod 90 in which the rollers 85 are mounted on the inwardly-turned ends. The member or rod 90, as shown by the arrow 92 in FIG. 3, may be rotated between either of two operating positions, in which the air cylinder attachment hole 94 is either spaced close to or more remote from the inside surface of the wall 44*b*. In this manner, the arrangement provides accommodation for different lengths of actuator rods of the cylinder 72.

The flanges 82 and 83 are spaced to form a close fit with the cam follower roller 85 so that limited rolling movement of the rollers 85 may take place during translational movement of the blade 20 from its retracted to its actuated position. This movement allows the rollers 85 and the air cylinder rod to move along the straight center lines 72 without incurring any side thrusts, while the followers move along an arc 95. Since the arc 95, representing the path of movement of the blade support arms as the blade is moved, is nearly tangent to the axis 73, thrust from the cylinder is applied along a straight line to the blade actuating arm portions 26 and 27, and generally normal to these arm portions at the retracted positions. In the preferred embodiments, the wall 44 is formed with about a 50° angle to the inside housing wall 65, and the straight line movement defined by the axis line 73 is normal or at right angles to the wall 44, defining the axis of the air cylinder 72 of FIG. 1.

The arrangement of the cam follower arm extensions 80 on the blade supporting arm provides a mechanically economical arrangement by which the work and force of the cylinder 72, applied through the piston rod 74, is directly and efficiently applied for rotating the blade 20 between its open and closed positions.

For instances where the loading on the blade 20 is anticipated to be high, or in instances where it is desirable to eliminate the roller, the arrangement shown in FIGS. 5 and 6 may be preferred. In this alternative arrangement, the means coupling the rod 94 to the blade arm 25 is a cross rod 100 which pivotally carries a threaded bock 105. The block 65 is threaded to receive an end of the piston rod 74. The cross rod 100 is, in turn, coupled to the blade arms 26 and 27 by means of coupling links 110. The links 110 are fixed to the opposite ends of the rod 100 and are arranged to pivot on arm extensions 112 on mounting pins 114 extending through the extensions 112. Again, as in the case of the U-shaped yoke or cross member 90, the relative position of the block 105 and cross rod 100 may be reversed by rotating the same through 180° on the links 110 to accommodate for different lengths of push rods or cylinder rods 74, within the interior of the housing.

The operation of this invention is largely self evidence from the foregoing description. The flow of dry particulate matter through the valve between the inlet 14 and outlet 15 may be controlled and, where required, proportionally controlled, by the position of the valve blade 20 within the conduit. The force applied by the air cylinder 72, through either of the connection arrangements described in FIGS. 4–6, is one in which the direct force of the rod 74 is applied with very little waste or side thrust to the arm 25 of the blade 20. In the case of the embodiment of FIGS. 3 and 4, the difference between the arcuate movement represented by the arc 95 and the straight line movement represented by the line 73 is accommodated by movement of the yoke 90 and rollers 85 within the roller guides or flanges 82 and 83. In the case of the embodiment of FIGS. 5 and 6, this movement is accommodated by the pivotal movement of the block 105 on the cross rod 100 and the pivotal movement of the end links 110 on the support pins 114. In either case, where there is a need to adjust for the available length of the cylinder piston rod 74, the relative position of the yoke 90 or the block 105 may be reversed.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A gate valve for handling dry particulate material, comprising:

a generally rectangular housing having a front wall, a pair of side walls, and a back wall defining a passageway extending from a valve inlet to a valve outlet, a curved flow control blade having a concave side and movable in said housing adjacent said inlet between said side walls with said concave side facing said outlet, means in said back wall defining a blade slot with a leading edge of said blade extending through said slot, blade support arm means positioned exteriorly of said back wall supporting a rear portion of said blade extending through said back wall slot, means on said side walls adjacent said outlet, pivotally mounting said blade support arm means for movement of said blade from a retracted position in which said blade is substantially withdrawn from said slot to a closed position in which said blade extends across said passageway in flow-blocking relation with said blade leading edge in abutment with said front wall, said housing including a laterally offset compartment enclosing the portion of said blade exteriorly of said back wall and enclosing said blade support arm means, said compartment being defined in part by an outer wall section which extends from a position adjacent said inlet diagonally outwardly away from said passageway and inwardly to said outlet and forming a relatively flat cylinder mounting surface, an air cylinder mounted on said cylinder mounting surface having a piston rod extending therethrough toward said blade support arm means, and connecting means connecting said piston rod with said arm means providing for the thrust of said cylinder to be applied to said arm means for effecting rotation of said blade on said arm means between its said retracted and closed positions.

2. The valve of claim 1 in which said blade support arm means comprises a pair of parallel spaced-apart arms having upper ends connected to said blade and having lower ends, means pivotally connecting said lower ends at said side walls adjacent said valve outlet, and said piston rod connecting means including a connector member extending between said arms and having opposite ends, means connecting said opposite ends of said member to said arms, said connector member being positionable in either of two positions providing accommodation for differing lengths of piston rods.

3. The valve of claim 2 in which said connector member is generally U-shaped having inwardly turned ends, roller means mounted on each said ends, and cam follower means on said blade support arms receiving said roller means and providing for arcuate movement of said cam follower means while said piston rod moves in a straight line between said blade retracted position and said closed position.

4. The valve of claim 1 in which said cylinder in which said cylinder mounting surface forms an angle of about 50° to said passageway.

5. A gate valve for handling dry particulate material comprising:

a housing having walls defining a passageway extending from a valve inlet to a valve outlet, a curved flow control blade having a concave side and movable across said passageway in said housing from a retracted open position to a closed flow-blocking position, said blade having a concave side facing said outlet in said flow blocking position, a pair of blade support arms having upper ends connected to support said blade and having lower ends pivotally connected to said housing adjacent said outlet, a piston supporting wall on said housing extending diagonally at an angle to the axis of said passageway, an air cylinder mounted on said inclined wall having a piston rod extending therethrough, the axis of movement of said rod being substantially tangential to the arc of movement of said arms, and coupling means connecting said rod to said arms.

6. The gate valve of claim 5 further comprising position indicator means including an indicator external of said housing, means mounting said visual indicator for rotation with pivotal movement of said blade support arms including a rod having an inner end connected to one of said arms and having an outer end connected to said indicator, said indicator providing a visual indication of blade position and blade movement.

7. In a gate valve for handling dry particular material in which a curved flow control blade is mounted on a pair of support arms and is movable between flow permitting and flow blocking positions to a flow conduit, said blade arms being mounted for rotation on pivot pins extending into bushings carried on the valve housing and movable about an axis of rotation defined by said pivot pins, the improvement in valve position indicator comprising:

a blade position pointer, said position pointer being mounted external of said housing and on an axis coincident with said blade arm axis, and means extending through one of said blade support pins connecting said indicator for movement by one of said blade arms.

* * * * *